United States Patent [19]

Vaterlaus

[11] Patent Number: 4,735,253

[45] Date of Patent: Apr. 5, 1988

[54] METHOD OF AND APPARATUS FOR CONVEYING A CONTINUOUSLY CAST STRAND

[75] Inventor: Arthur Vaterlaus, Rüschlikon, Switzerland

[73] Assignee: Concast Service Union AG, Zurich, Switzerland

[21] Appl. No.: 885,876

[22] Filed: Jul. 15, 1986

[30] Foreign Application Priority Data

Jul. 16, 1985 [CH] Switzerland ..... 03077/85

[51] Int. Cl.[4] ..... B22D 11/04; B22D 11/18; B22D 11/20

[52] U.S. Cl. ..... 164/453; 164/413; 164/449; 164/452; 164/454; 164/472; 164/478; 164/484; 164/486

[58] Field of Search ..... 164/483, 478, 454, 413, 164/416, 452, 453, 472, 484, 486, 449

[56] References Cited

U.S. PATENT DOCUMENTS

| | | | |
|---|---|---|---|
| 3,478,808 | 11/1969 | Adams | 164/454 |
| 3,521,696 | 7/1970 | Lowman et al. | 164/413 X |
| 3,669,176 | 6/1972 | Krall et al. | 164/478 |
| 3,786,856 | 1/1974 | Nishikawa | 164/454 X |
| 3,817,313 | 6/1974 | Gamble et al. | 164/478 |

FOREIGN PATENT DOCUMENTS

| | | | |
|---|---|---|---|
| 56-105859 | 8/1981 | Japan | 164/413 |
| 57-75276 | 5/1982 | Japan | 164/483 |

*Primary Examiner*—Nicholas P. Godici
*Assistant Examiner*—J. Reed Ratten, Jr.
*Attorney, Agent, or Firm*—Peter K. Kontler; Tobias Lewenstein

[57] ABSTRACT

A continuous casting apparatus includes a continuous casting mold, a guide downstream of the mold for guiding a continuously cast strand issuing from the mold, and a drive unit for drawing the strand out of the mold and through the guide. The drive unit is connected with a computer programmed to reciprocate the strand in the guide and the mold in the event of an interruption in the supply of molten material to the mold.

36 Claims, 1 Drawing Sheet

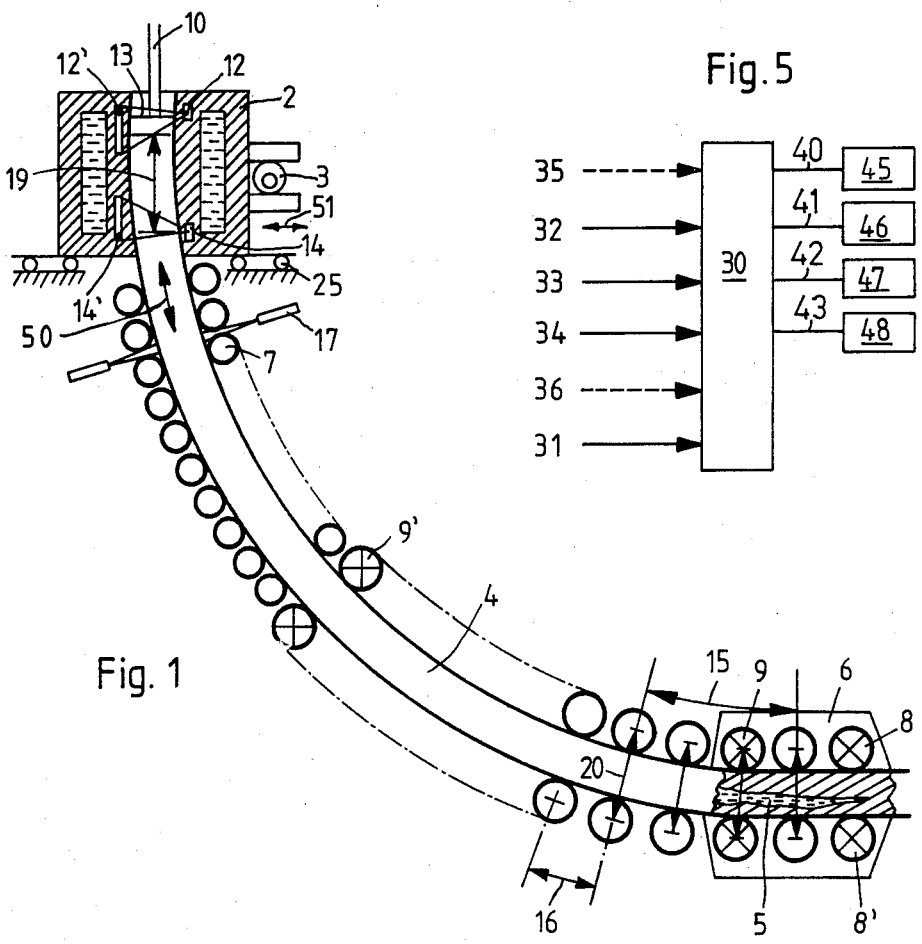
Fig. 1
Fig. 5
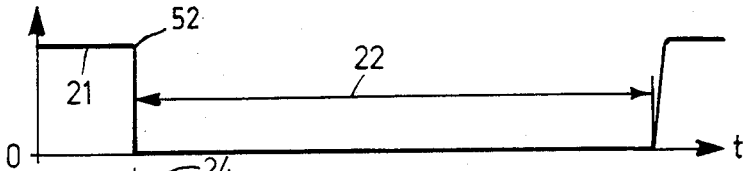
Fig. 2
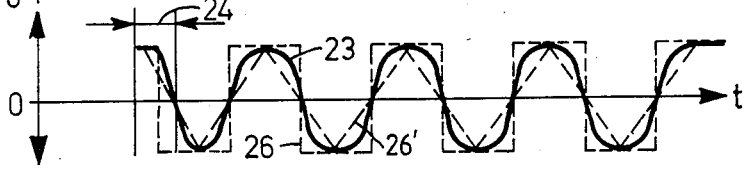
Fig. 3
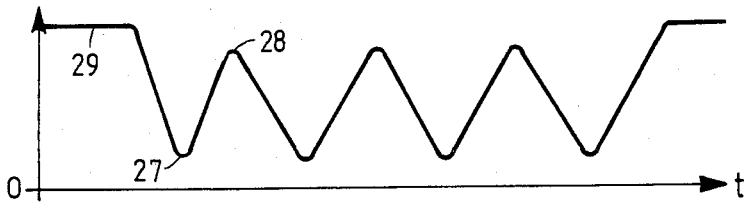
Fig. 4

METHOD OF AND APPARATUS FOR CONVEYING A CONTINUOUSLY CAST STRAND

BACKGROUND OF THE INVENTION

The invention relates generally to a method of and an apparatus for the continuous casting of metals, e.g., steel.

More particularly, the invention relates to a method of and an apparatus for conveying a continuously cast strand.

In the continuous casting of steel, the strand formed in the continuous casting mold is continuously withdrawn from the latter and then advanced through a secondary cooling zone. The secondary cooling zone may include a guide for the strand, and such guide is normally made up of pairs of guide rollers arranged in a row.

The strand is drawn out of the mold and through the guide by one or more drive units which, as a rule, comprise cooperating pinch rollers. However, drive units consisting of driven guide rods designated "walking beams" are also known. In addition to strand withdrawal, the drive units serve to feed a dummy bar into the mold before the start of a casting operation.

During a continuous casting operation, the strand is drawn out of the mold and the strand guide at as uniform a speed as possible. Although it is desirable to keep the strand moving continuously at a uniform speed throughout the casting operation, there are nevertheless situations in which the supply of steel to the mold and withdrawal of the strand must be interrupted. This can occur when there is a disturbance in operation or when a tundish change is performed during a long casting cycle. In such situations, and also at the end of the casting operation, the bath in the mold is slagged off while the strand is kept stationary or is moved at a creep. The strand is solidified by cooling with water and is subsequently drawn out of the mold at low speed.

Both the strand and the continuous casting apparatus are adversely affected whenever the strand is stopped or moved at a creep. The ferrostatic pressure in the strand causes bulging of the latter to an extent depending upon the previous casting speed, the size and/or shape of the strand, and the pitch of the rollers of the strand guide. When the drive units are restarted to withdraw the strand from the apparatus, the bulges are rolled flat thereby leading to internal cracking of the strand.

If the strand is stationary, the size of the bulges can be reduced by intense cooling. However, this leads to supercooling of localized areas of the strand while adjacent areas are not cooled at all or are cooled only slightly. Such variations in strand cooling generate surface cracks in the strand. Moreover, in continuous casting apparatus having a curved strand guide, the stress on the straightening rollers and their bearings is increased several times when supercooled sections of a strand are transported through the straightening unit.

As already mentioned, strand stoppages are also detrimental to the continuous casting apparatus, especially the rollers. The intense and, depending upon the stoppage time, prolonged heating of a roller surface in contact with a hot strand leads to surface cracks in the roller. Furthermore, the cooling of the portion of the roller facing away from the strand causes deformation and bending of the roller. The result is permanent roller bending and non-circular running of the roller leading to overloading of the bearings and the strand guide. Permanent roller bending, like the removal of bulges by rolling, is further detrimental to the strand. In addition, bent rollers cause the strand to be improperly guided which, in turn, leads to overloading of the rollers and their drive motors. This may necessitate interruption of the casting operation.

In order to avoid or reduce faulty operation and damage to the strand and rollers, it has been proposed to construct the rollers with multiple supports and large drive motors, and even to provide heavy additional withdrawal stands. Expensive roller designs and roller coatings, which make the continuous casting apparatus more expensive and increase maintenance costs, have also been proposed in order to render the rollers insensitive to surface cracks. However, all such measures are undesirable because of the relatively great expense associated therewith, particularly in the case of slab casters having a large width and bloom casters having long strand guides.

OBJECTS AND SUMMARY OF THE INVENTION

It is an object of the invention to provide a continuous casting method which makes it possible to avoid or reduce damage to the strand and/or to the continuous casting apparatus whenever the supply of molten material to the mold is discontinued, i.e., whether the supply of molten material is discontinued in the midst of a casting operation or at the end thereof.

Another object of the invention is to provide a continuous casting method which allows a casting operation to be restarted after an interruption of 10 minutes and more with little or no effect on the quality of the strand and little or no damage to the continuous casting apparatus.

An additional object of the invention is to provide a continuous casting method which enables productivity and profitability to be increased.

A further object of the invention is to provide a continuous casting apparatus which makes it possible to avoid or reduce damage to the strand and/or to the apparatus whenever the supply of molten material to the mold is discontinued, i.e., whether the supply of molten material is discontinued in the midst of a casting operation or at the end thereof.

It is also an object of the invention to provide a continuous casting apparatus which allows a casting operation to be restarted after an interruption of 10 minutes and more with little or no effect on the quality of the strand and little or no damage to the apparatus.

Yet another object of the invention is to provide a continuous casting apparatus which enables productivity and profitability to be increased.

The preceding objects, as well as others which will become apparent as the description proceeds, are achieved by the invention.

One aspect of the invention resides in a method of continuously casting metals, particularly steel. The method involves continuously admitting molten metal into a first end of a casting passage, and cooling the metal in the casting passage so that the metal is at least partially solidified and forms a continuously cast strand. The strand is advanced through a second end of the casting passage into and along a predetermined path. The method further involves interrupting the admitting step, and thereafter reciprocating the strand in the predetermined path. Preferably, the reciprocating step is performed essentially continuously.

The method may further comprise the step of cooling the strand in the predetermined path during the admitting step.

The advancing step may be performed by engaging the strand with movable drive surfaces, and the reciprocating step then comprises moving the strand relative to the drive surfaces. The drive surfaces may be rotary surfaces.

The predetermined path of the strand may be bounded at least in part by guide surfaces for the strand, and the reciprocating step here comprises moving the strand relative to the guide surfaces. The guide surfaces may again be rotary surfaces.

Another aspect of the invention resides in an apparatus for the continuous casting of metals, particularly steel. The apparatus comprises a continuous casting mold, and withdrawing means for withdrawing a continuously cast strand from the mold and advancing the strand along a predetermined path. The apparatus further comprises control means connected with the withdrawing means and programmed to enable the latter to reciprocate the strand in the predetermined path.

The withdrawing means preferably includes at least one pair of cooperating, driven rollers.

The withdrawing means may be disposed downstream of and at a distance from the mold. If necessary or desirable, strand guide means may here be interposed between the mold and the withdrawing means.

The method and apparatus of the invention enable both the internal quality and surface quality of the strand to be improved while, at the same time, allowing wear on the apparatus to be reduced. In particular, it becomes possible to extend roller life and the duration of roller alignment. This enables maintenance costs to be reduced. Moreover, since the strand need no longer be completely stopped for extended periods, the design load of the apparatus may be decreased thereby allowing the latter to be constructed more advantageously. For example, the number of bearings for each roller can be reduced.

The strand may be reciprocated immediately after a breakout, i.e., a rupture of the strand accompanied by an escape of part of the molten core, while the temperature is still high in order to cut off the so-called drainage skull which may develop, e.g., on a cooling grid, or to roll it via strand guide rolls.

As mentioned earlier, the continuous casting apparatus may include strand guide means, and the strand guide means may comprise a multiplicity of roller pairs arranged in a row. The stroke of the strand during reciprocation may then be based on the maximum roller pitch and may, for instance, approximate or equal one-half of the maximum roller pitch. However, the stroke is preferably at least equal to the maximum roller pitch in the zone of strand shell support, i.e., the zone in which the strand is not solidified throughout and still has molten core, in order that essentially the entire surface of the strand in this zone may receive support during each reciprocation cycle. The stroke may be optimized further by setting it equal or approximately equal to one-half of the average circumference of the rollers within the zone of strand shell support.

The stroke of the strand during reciprocation may, in addition, be selected so as to satisfy the formula $S \geqq ML - 250$ mm, where S is the stroke in millimeters and ML is the length of the mold in millimeters.

The speed at which the strand is reciprocated may be based on the average roller pitch in the zone of strand shell support so that, as the roller pitch increases, the speed of reciprocation increases proportionately. In accordance with a further feature of the invention, the strand is reciprocated so that, during each half cycle, the strand reaches a speed which at least equals the prescribed casting speed prior to interruption of the supply of molten metal to the mold. The strand may be accelerated from and decelerated to the two dead points of its reciprocatory movement in any fashion. For large slabs, the masses to be accelerated and decelerated are large and it is therefore proposed to vary the speed of the strand sinusoidally or to increase and decrease the speed of the strand linearly.

The strand may be subjected to secondary cooling after leaving the mold, and such secondary cooling may involve directing sprays of cooling water against the strand. When the supply of molten metal to the mold is interrupted for a short period and the strand undergoes few reciprocations, the secondary cooling may be left unchanged. On the other hand, during extended interruptions, or in cases where the specific quantity of cooling water is high, it is recommended that secondary cooling be reduced or discontinued while the strand is reciprocated. The secondary cooling may be reduced or discontinued stepwise during strand reciprocation in accordance with a predetermined program. For example, the secondary cooling may initially be reduced or discontinued in the withdrawing means or withdrawal unit and then reduced or discontinued stepwise from the withdrawing means to the mold.

When molten metal is being supplied to the mold, a pool or bath of molten metal exists in the mold. The supply of molten metal is controlled in such a manner as to maintain the surface of the bath approximately at a predetermined level. In order to avoid damage to the mold walls in the region of this level when the strand is reciprocated, it is proposed to limit reciprocation of the section of the strand in the mold to a zone below the predetermined level.

The mold is normally oscillated while molten metal is being supplied thereto, and such oscillation may also be carried out during reciprocation of the strand. However, it is recommended to briefly suspend oscillation of the mold after the supply of molten metal is interrupted and before or, at the latest, during the first backward movement of the strand. This enables the end of the strand shell in the region of the bath level to develop a perfectly round edge.

A lubricant may be supplied to the mold during strand reciprocation in order to maintain or enhance lubrication. The lubricant, which may be in the form of a fluid slag, preferably contains one or more exothermic additives.

Detector means may be provided to continuously monitor the position of the end of the strand in the mold. Such detector means makes it possible to control and/or monitor the reciprocatory movement of the strand. The detector means may be connected to the control means for the withdrawing means.

The detector means may include a pair of spaced detecting units one of which monitors the upper dead point of the strand end in the mold and the other of which monitors the lower dead point.

The continuous casting apparatus may be provided with a device for regulating the level of the bath in the mold. This type of device again includes a detecting unit. Advantageously, the detecting unit of the bath regulating device is used to monitor the upper dead point of the strand end so that only a single additional detecting unit is required to monitor the position of the strand end, namely, a detecting unit for the lower dead point.

The continuous casting apparatus may have a curved mold or strand guide. In an apparatus of this type, it is difficult to achieve uniform cooling of the inner and outer arcs of the strand so that some deformation of the latter may occur. In order to avoid scratching of the inside of the mold during reciprocation of deformed strands, it is recommended to mount the mold so as to be movable by a reciprocating strand along a direction transverse or normal to the direction of movement of the latter.

If the mold is a plate mold, that is, a mold having two narrow and two wide sides in the form of separate plates which are held together to define a casting passage, the distance between the wide sides may be increased during prolonged interruptions in the supply of molten metal to the mold.

In the event that the continuous casting apparatus has a curved secondary cooling zone, pairs of bending or straightening rollers are disposed in the region of the end of such zone to straighten the strand. A reciprocating strand will pass through these rollers in opposite directions during each cycle thereby undergoing straightening during each forward stroke and bending during each backward stroke. According to a further embodiment of the invention, the pairs of straightening rollers are mounted in such a manner as to be shiftable by the strand transverse to the direction of movement of the latter. This enables bending and straightening of the strand during reciprocation to be considerably reduced. Mounting of the straightening rollers so as to be shiftable by the strand is particularly recommended when casting metals which are prone to develop cracks.

The withdrawing means may comprise a plurality of pairs of pinch or drive rollers which are disposed at spaced locations of the secondary cooling zone. This allows tensile and compressive forces generated longitudinally of the strand shell during reciprocation to be reduced while, at the same time, reducing slippage between the strand and the withdrawing means.

Modern continuous casting apparatus are frequently provided with warning systems for strand shell cracks in the mold. These warning systems, which generate breakout warning signals, are designed to automatically stop the strand and to interrupt the supply of molten metal to the mold. Stopping of the strand under such circumstances also brings about the previously described detrimental effects on the strand and the apparatus. Particularly in apparatus operating at high casting speeds, pronounced bulging of the strand already occurs shortly after a sudden stoppage. In order to reduce or eliminate detrimental effects on the strand and the apparatus, it is recommended that the supply of molten metal to the mold, as well as strand withdrawal, be interrupted in response to a signal from a breakout warning device, and that reciprocation of the strand then be initiated by moving the strand backwards.

The novel features which are considered as characteristic of the invention are set forth in particular in the appended claims. The improved continuous casting apparatus itself, however, both as to its construction and its mode of operation, together with additional features and advantages thereof, will be best understood from a perusal of the following detailed description of certain specific embodiments with reference to the accompanying drawings.

BRIEF DESCRIPTION OF THE DRAWINGS

FIG. 1 is a schematic partly sectional elevational view of a continuous casting apparatus according to the invention;

FIG. 2 is a plot showing how the supply of molten metal to a mold varies with time in a continuous casting method according to the invention;

FIG. 3 is a plot showing the variation of speed with time when reciprocating a continuously cast strand in accordance with the invention;

FIG. 4 is a plot showing how the bath level in a mold varies with time in a continuous casting method according to the invention; and FIG. 5 is a block diagram of a control system for the apparatus of FIG. 1.

DESCRIPTION OF THE PREFERRED EMBODIMENTS

FIG. 1 illustrates a continuous casting apparatus in accordance with the invention. The apparatus is of the arc type and is particularly well-adapted for the continuous casting of steel. The apparatus includes a continuous casting mold 2 which is cooled in a conventional manner and defines a curved, generally vertical casting passage. A conventional oscillator 3 is arranged to oscillate the mold 2 along a curved path corresponding to the curved contour of the casting passage.

A guide 7 for a continuously cast strand 4 formed in the mold 2 is located below the latter and comprises a series of pairs of rollers arranged in a row. The strand guide 7, which is again curved, extends from the mold 2 to a drive unit 6 which functions to draw the strand 4 through the lower end of the casting passage and into and along the path defined by the strand guide 7. The drive unit 6 comprises a first pair of pinch or drive rollers 8,8' and a second pair of pinch or drive rollers denoted by the reference numeral 9. An additional pair of pinch or drive rollers designated as 9' is spaced from the drive unit 6 and is located approximately midway along the strand guide 7.

The drive unit 6 and the additional pinch rollers 9' may each be considered to constitute a means for withdrawing the strand 4 from the mold 2 and advancing the strand 4 into and along the path defined by the strand guide 7.

The reference numeral 10 identifies a pouring device for admitting molten metal, e.g., molten steel, into the upper end of the casting passage.

A detecting unit is mounted near the upper or inlet end of the mold 2 and includes a signal emitter 12 and a signal receiver 12', e.g., a radioactive emitter and receiver. The detecting unit 12,12' serves to monitor the upper surface of the molten metal bath or pool which is present in the mold 2 during a casting operation. The detecting unit 12,12' is connected with an inflow control device which automatically regulates the rate of admission of molten metal into the mold 2 so that the upper surface of the bath is automatically maintained approximately at a predetermined level 13 of the mold 2.

A second detecting unit including a signal emitter 14 and a signal receiver 14' is mounted near the lower or outlet end of the mold 2.

The reference numeral 15 identifies a straightening zone in which the strand 4 is straightened as it enters the drive unit 6. The straightening zone 15 comprises several pairs of straightening rollers and is located in the region of the exit end of the strand guide 7.

Cooling devices 17 for secondary cooling of the strand 4 are disposed at spaced locations along the strand guide 7. The cooling devices 17 may, for instance, be in the form of spray nozzles which are arranged to direct cooling water against the strand 4. The strand guide 7 may be considered to define a secondary cooling zone for the strand 4.

In operation, molten metal, which is here assumed to be steel, is continuously teemed into the upper end of the mold 2 via the pouring device 10 while the mold 2 is oscillated by means of the oscillator 3. The molten steel forms a bath or pool in the mold 2, and the steel adjacent to the walls of the casting passage, cools and solidifies to form a thin shell which surrounds the bath. The shell and its molten core together constitute the strand 4.

The drive unit 6 and pinch rollers 9' continuously draw the strand 4 through the lower end of the mold 2 and into and along the path defined by the strand guide 7. As the strand 4 advances along the guide 7, cooling fluid is directed against the strand 4 by the cooling devices 17. The strand 4 is thus subjected to secondary cooling in the strand quide 7 so that the thickness of its shell increases progressively while the size of its molten core decreases progressively with increasing distance from the mold 2.

As indicated by the reference numeral 5, the molten core of the strand 4 extends to the end of the drive unit 6, that is, to the pinch rollers 8,8'. Since the molten core generates a high ferrostatic pressure on the strand shell from internally, support for the strand shell is required from the lower end of the mold 2 to the pinch rollers 8,8' in order to prevent bulging of the strand 4. The strand guide 7 and drive unit 6 provide such support.

Upon entering the straightening zone 15, the strand 4 is straightened so that it is essentially flat and horizontal when it exits the drive unit 6.

The detecting unit 12,12' continuously monitors the position of the upper surface 13 of the bath in the mold 2. The rate of admission of molten steel into the mold 2 is adjusted in response to signals from the detecting unit 12,12' such that the upper surface of the bath is maintained approximately at the predetermined level 13. In order to maintain the upper surface of the bath in the region of the predetermined level 13, the rate of admission of molten steel into the mold 2 is regulated in dependence upon the travel speed of the strand 4 through the guide 7. This speed, which is predetermined based upon the casting parameters, is referred to as the casting speed.

The manner of starting the strand 4 has not been described here since it is entirely conventional and does not constitute part of the invention per se.

In the event that the supply of molten steel to the mold 2 is interrupted, the level of the bath in the mold 2 falls if the strand 4 continues to be withdrawn therefrom. The speed of the strand 4 during this drop in the bath level may be preprogrammed to be the predetermined casting speed or a lower speed. If the bath level falls to the detection range of the lower detecting unit 14,14', the drive unit 6 and pinch rollers 9' are reversed so that, instead of pulling the strand 4 forward, i.e., in a direction from the mold 2 to the drive unit 6, the pinch rollers 9' and drive unit 6 now push the strand 4 backwards towards the mold 2. As a result, the end of the strand 4 inside the mold 2 moves upwards. When this end of the strand 4 reaches the detection range of the upper detecting unit 12,12', the drive unit 6 and pinch rollers 9' are again reversed so that the strand 4 once more moves forward. This sequence is repeated thereby causing the strand 4 to be reciprocated in the guide 7 and the mold 2 as indicated by the double-headed arrow 50. Reciprocation of the strand 4 is continued as long as the supply of molten steel to the mold 2 is interrupted. The strand 4 reciprocates relative to the drive unit 6, the guide 7 and the pinch rollers 9'. Preferably, the strand 4 is reciprocated essentially continuously during interruption of the supply of molten steel to the mold 2.

The detecting unit 12, 12', which functions to monitor the bath level while molten steel is being teemed into the mold 2, serves to monitor the position of the strand end in the mold 2 when the supply of molten steel to the latter is interrupted.

Oscillation of the mold 2 is discontinued, at least briefly, after the supply of molten steel is interrupted. The oscillation may be stopped prior to initiating reciprocation of the strand 4, that is, before the first backward stroke of the strand 4, or while reciprocation is being initiated, i.e., during the first backward stroke, but no later. Discontinuing oscillation of the mold 2 gives the end of the strand 4 inside the mold 2 a chance to develop a round edge. Oscillation of the mold 2 may subsequently be restarted if desirable or necessary so that the mold 2 oscillates while the strand 4 reciprocates.

A lubricant may be feed into the upper end of the mold 2 during reciprocation of the strand 4 in order to maintain or enhance lubrication. The lubricant may be in the form of a fluid slag and preferably contains one or more exothermic components.

The stroke of the strand 4 during reciprocation may be selected so as to be equal to or greater than the maximum roller pitch in that portion of the path of the strand 4 along which the latter has a molten core and requires support to counteract the resulting ferrostatic pressure. As mentioned earlier, the molten core 5 in the illustrated embodiment extends from the mold 2 to the end of the drive unit 6 so that the strand 4 requires support throughout this zone which may be referred to as the strand shell support zone. The maximum roller pitch in such zone is identified by the reference numeral 16.

The length of the mold 2 may also be taken into account when selecting the stroke of the strand 4. The stroke advantageously satisfies the formula $S \leqq ML - 250$ mm where S is the stroke in millimeters and ML is the length of the mold in millimeters. The length of the mold 2 is the dimension extending along the direction of movement of the strand 4.

Upon optimum adjustment of the parameters taken into account during determination of the stroke of the strand 4, the stroke will be at least approximately equal to one-half of the average circumference of the rollers within the strand shell support zone.

The formula $S = ML - 250$ mm may be used to set the maximum stroke. Assuming a mold length of 900 mm, the maximum stroke of the strand 4 is equal to 650 mm. As a rule, the maximum distance between the rollers of a slab caster in the strand shell support zone, i.e., the maximum roller pitch in the strand shell support zone, ranges from about 400 mm to about 600 mm. If the average roller diameter is assumed to be 400 mm, one-half of the average circumference of the rollers is 628 mm. The optimum value of the stroke taking into account the three factors described above, namely, mold length, roller pitch and roller diameter, is then 630 mm. In the event that the average roller diameter is smaller, a shorter stroke may be used. For instance, a stroke of 550 mm suffices for an average roller diameter of 350 mm.

The stroke of the strand 4 determines the distance 19 through which the end of the strand 4 moves in the mold 2 during reciprocation. The stroke is selected in such a manner that, as a rule, the end of the strand 4 neither leaves the mold 2 nor ascends to the predetermined level 13 for the upper surface of the bath.

Once reciprocation of the strand 4 has been initiated, the flow of cooling fluid from the cooling devices 17 is reduced or discontinued. When reference is made hereinafter to reducing the flow of cooling fluid, this is intended to include a reduction of the flow to zero, i.e., to include discontinuing the flow of cooling fluid. Depending upon the grade of steel, the flow of cooling fluid may be reduced stepwise during reciprocation in accordance with a predetermined program. For instance, the reduction in the flow of cooling fluid may be initiated at the drive unit 6 and continued stepwise from there to the mold 2.

As mentioned previously, the mold 2 may be oscillated while the strand 4 reciprocates. The oscillatory motion of the mold 2 is preferably coordinated with the reciprocatory movement of the strand 4. In this manner, scratching and wear of the inside of the mold 2 may be reduced.

As the strand 4 reciprocates, the section of the strand 4 in the region of the straightening zone 15 is straightened during each forward stroke and bent back to its previous configuration during each backward stroke. In order to reduce straightening and bending of the strand 4 during reciprocation, the roller pairs in the straightening zone 15 may be mounted so as to be shiftable by the strand 4 transversely of the direction of movement of the latter. Such mounting of the roller pairs in the straightening zone 15 is indicated by the double-headed arrows 20. By mounting the roller pairs in the straightening zone 15 for movement transverse to the path of the strand 4, the amount of straightening undergone by the latter during a forward stroke is less than if the roller pairs were fixed. The roller pairs in the straightening zone 15 may be designed so that they are free to shift during normal operation as well as reciprocation. However, the roller pairs may also be designed in such a manner that they can be arrested during normal operation and released by remote control for reciprocation.

Mounting of the roller pairs in the straightening zone 15 for movement is of particular advantage when casting crack-sensitive steels.

The mold 2 may be mounted on rollers 25 so as to allow the mold 2 to be shifted by the strand 4 along a direction which is at least approximately perpendicular to the direction of movement of the strand 4. The manner in which the mold 2 may be shifted by the strand 4 is indicated by the double-headed arrow 51. Mounting of the mold 2 so as to be movable by the strand 4 makes it possible for the position of the mold 2 to be adjusted to that of the strand 4. This helps to reduce scratching and wear of the inside of the mold 2.

A first support zone for the strand 4 may be mounted at the lower end of the mold 2 for movement with the latter.

FIG. 2 is a diagram representing the rate of admission of molten steel into the mold 2 as a function of time. The vertical axis corresponds to the rate of admission while the horizontal axis represents time. The reference numeral 21 identifies a plot of rate of admission versus time. The initial part of the plot 21 corresponds to normal operation and shows that molten steel is being teemed into the mold 2 at a predetermined rate. At a time indicated by the reference numeral 52, the supply of steel to the mold 2 is interrupted, e.g., in order to exchange tundishes. The supply of steel remains interrupted for a time interval 22 after which steel is once again teemed into the mold 2. The strand 4 is reciprocated during the time interval 22.

FIG. 3 is a diagram showing how the speed of the strand 4 varies with time as the strand 4 reciprocates. Speed is represented on the vertical axis whereas time is again represented on the horizontal axis. The reference numeral 23 identifies a first plot of speed versus time for the time interval 22 of FIG. 2. According to the plot 23, the strand 4 continues to be drawn forward for a time interval 24 following interruption of the steel supply at the time 52 (FIG. 2). Forward movement of the strand 4 is continued until it reaches the lower dead point of its reciprocatory movement, i.e., the dead point determined by the detecting unit 14,14'. Subsequently, the strand 4 is reciprocated with a stroke 19 (FIG. 1) in such a manner that its speed varies sinusoidally with time as shown by the plot 23. Reciprocation of the strand 4 is discontinued after the time interval 22 (FIG. 2), that is, once the supply of molten steel to the mold 2 is resumed.

The reference numeral 26 in FIG. 3 identifies a second plot of speed versus time for reciprocation of the strand 4. The plot 26 resembles a square wave or rectangular wave.

The reference numeral 26' in FIG. 3 identifies yet another plot of speed versus time for reciprocation of the strand 4. The plot 26' which resembles a sawtooth wave, shows that the strand 4 is accelerated and decelerated constantly, i.e., the speed of the strand 4 increases and decreases linearly.

Regardless of how the speed of the strand 4 varies with time during reciprocation, it is preferred for the speed in each half-cycle to at least reach the casting speed which was in effect prior to interruption of the supply of molten steel to the mold 2.

FIG. 4 is a diagram showing how the height of the end of the strand 4 in the mold 2 varies with time during reciprocation. Height is represented on the vertical axis and time is once more represented on the horizontal axis. The horizontal axis in FIG. 4, that is, the zero point of the vertical coordinate, corresponds to the lowermost point of the mold 2. The reference numeral 29 identifies the predetermined level 13 (FIG. 1) of the mold 2 at which the upper surface of the bath is approximately maintained during normal operation. The reference numeral 27 identifies the lower dead point of the reciprocatory movement of the strand end while the reference numeral 28 identifies the upper dead point of such movement. The direction of movement changes at the dead points 27,28. It will be observed that the upper dead point 28 always lies below the level 29 of the upper surface of the bath during normal operation.

FIG. 5 is a block diagram of a control system for the continuous casting apparatus of FIG. 1. The control system includes a computer 30 having an input 31 which continuously receives a signal from a stopper control, a slide valve control or another means for regulating the flow of molten steel into the mold 2. The computer 30 has a second input 32 which continuously receives signals from the detecting devices 12,12' and 14,14', as well as a third input 33 for signals representing the level of the oscillating mold 2. The computer 30 is provided with yet another input 34 which is designed to receive signals from a breakout warning system, e.g., a system based on measurement of the temperature of the mold walls.

An additional input 35 of the computer 30 functions to program the latter with the intended reciprocatory motion of the strand 4. The computer 30 also has an input 36 which serves to program the computer 30 with data regarding the intended cooling of the strand 4 during reciprocation. The programs fed into the computer 30 via the inputs 35,36 enable the computer 30 to operate the continuous casting apparatus according to the method of the invention in the event of a disturbance or an interruption in the supply of molten steel to the mold 2. The computer 30 may cause the apparatus to operate in accordance with the method of the invention automatically or in response to depression of a button.

If the continuous casting apparatus is provided with a breakout warning system, the computer 30 may be programmed so that, upon receipt of a signal from this system, the supply of steel to the mold 2 is automatically interrupted and reciprocation of the strand 4 is automatically initiated. Such a signal is an indication that the shell of the strand 4 has ruptured.

The computer 30 has a first output 40 which is connected with drive motors 45 for the pinch rollers 8,8'; 9; and 9'. The computer 30 further has a second output 41 which is connected with valve means 46 for the cooling devices 17, and a third output 42 which is connected with drive means 47 for a stopper or slide valve. An additional output 43 of the computer 30 is connected with drive means 48 for the mold oscillator 3. The drive motors 45, valve means 46 and drive means 47,48 are controlled by the computer 30 according to the method of the invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A continuous casting method, comprising the steps of continuously admitting molten metal into a first end of a casting passage; cooling said metal in said casting passage so that said metal is at least partially solidified and forms a continuously cast strand; continuously advancing said strand through a second end of said casting passage into and along a predetermined path; interrupting the admitting step; reciprocating said strand in said path after the interrupting step; restarting the admitting step; and thereafter again continuously advancing said strand through said second end of said casting passage into and along said predetermined path.

2. The method of claim 1, wherein said metal is steel.

3. The method of claim 1, comprising the step of cooling said strand in said path during the admitting step.

4. The method of claim 1, wherein the reciprocating step is performed essentially continuously.

5. The method of claim 1, the advancing steps being performed by engaging said strand with movable drive surfaces; and wherein the reciprocating step comprises moving said strand relative to said drive surfaces.

6. The method of claim 5, said path being bounded at least in part by guide surfaces for said strand; and wherein the reciprocating step comprises moving said strand relative to said guide surfaces.

7. The method of claim 6, wherein said surfaces are rotary surfaces.

8. The method of claim 1, said strand having a molten core throughout at least a portion of said path, and said portion of said path being bounded by rotary surfaces having a maximum pitch; and wherein the stroke of the reciprocating step is at least equal to said maximum pitch.

9. The method of claim 1, said casting passage having a predetermined length; and wherein the stroke of the reciprocating step is less than or equal to said predetermined length in millimeters minus 250 millimeters.

10. The method of claim 1, said strand having a molten core throughout at least a portion of said path, and said portion of said path being bounded by rotary surfaces of circular outline; and wherein the stroke of the reciprocating step is at least approximately equal to one-half of the average circumference of said rotary surfaces.

11. The method of claim 1, wherein the first advancing step is performed at a predetermined speed, and the speed during the reciprocating step at least reaches said predetermined speed.

12. The method of claim 1, wherein the reciprocating step comprises increasing the speed of said strand substantially linearly.

13. The method of claim 1, wherein the reciprocating step comprises decreasing the speed of said strand substantially linearly.

14. The method of claim 1, comprising the steps of cooling said strand in said path during the admitting step by directing a cooling fluid against said strand at a predetermined rate, and reducing the flow of said cooling fluid below said predetermined rate subsequent to the interrupting step.

15. The method of claim 14, wherein the reducing step comprises discontinuing the flow of said cooling fluid.

16. The method of claim 14, wherein the reducing step is performed stepwise along said predetermined path.

17. The method of claim 16, wherein the reducing step is performed from a downstream to an upstream location of said path.

18. The method of claim 1, said casting passage being generally vertical, and the admitting step comprising forming a pool of molten metal in said casting passage, and maintaining the upper surface of said pool approximately at a predetermined level; and wherein the reciprocating step is performed in such a manner that said strand is reciprocated in said casting passage below said predetermined level.

19. The method of claim 1, comprising the steps of oscillating said casting passage during the admitting step, and stopping said casting passage subsequent to the interrupting step but no later than during initiation of the reciprocating step.

20. The method of claim 19, wherein the stopping step is initiated prior to the reciprocating step.

21. The method of claim 19, wherein the stopping step is performed temporarily and said casting passage is again oscillated during the reciprocating step.

22. The method of claim 1, comprising the step of introducing a lubricant into said casting passage during the reciprocating step.

23. The method of claim 22, wherein said lubricant comprises a fluid slag.

24. The method of claim 22, wherein said lubricant comprises an exothermic component.

25. The method of claim 1, wherein the interrupting and reciprocating steps occur in automatic response to rupture of said strand.

26. A continuous casting apparatus, particularly for the continuous casting of steel, comprising a continuous casting mold; withdrawing means for withdrawing a continuously cast strand from said mold and advancing the strand along a predetermined path, said path having an arcuate portion; strand straightening means in the region of the downstream end of said arcuate portion, said straightening means including a straightening element movable transversely of said path by the strand; and control means connected with said withdrawing means and programmed to enable the latter to reciprocate the strand in said path.

27. The apparatus of claim 26, wherein said withdrawing means comprises at least one pair of cooperating rollers.

28. The apparatus of claim 26, said withdrawing means being disposed downstream of and at a distance from said mold; and further comprising strand guide means intermediate said mold and said withdrawing means.

29. The apparatus of claim 26, comprising detecting means for monitoring the position of the end of the strand in said mold, said detecting means being connected with said control means.

30. The apparatus of claim 29, wherein said detecting means is designed to continuously monitor the position of the strand end.

31. The apparatus of claim 29, wherein said detecting means comprises a pair of spaced detecting units.

32. The apparatus of claim 26, wherein said mold is mounted to be movable transversely of said path by the strand.

33. The apparatus of claim 26, said straightening means includes a plurality of pairs of rollers, and at least one roller of each pair is mounted to be movable transversely of said path by the strand.

34. The apparatus of claim 33, wherein both rollers of each pair are movable transversely of said path by the strand.

35. The apparatus of claim 26, wherein said withdrawing means comprises a plurality of pairs of rollers disposed at spaced locations of said path.

36. A continuous casting method, comprising the steps of continuously admitting molten metal into a first end of a casting passage; cooling said metal in said casting passage so that said metal is at least partially soliifed and forms a continuously cast strand; continuously advancing said strand through a second end of said casting passage into and along a predetermined path; generating a warning signal in response to detection of an imperfection in said strand; interrupting the admitting and advancing steps in response to said warning signal; reciprocating said strand in said path after the interrupting step, the reciprocating step being initiated by moving said strand in upstream direction of said path; restarting the admitting step; and thereafter again continuously advancing said strand through said second end of said casting passage into and along said predetermined path.

* * * * *